US006557307B2

(12) United States Patent
Reddig

(10) Patent No.: US 6,557,307 B2
(45) Date of Patent: May 6, 2003

(54) UPRIGHT PANEL WITH HEIGHT ADJUSTABLE BACK CUSHION

(75) Inventor: Ralph E. Reddig, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/878,758

(22) Filed: Jun. 11, 2001

(65) Prior Publication Data

US 2002/0184832 A1 Dec. 12, 2002

(51) Int. Cl.[7] ..... A47F 10/00

(52) U.S. Cl. ..... 52/36.1; 297/284.7; 297/217.7; 297/423.41; 297/162

(58) Field of Search ..... 52/36.1; 297/284.7, 297/217.7, 423.41, 162

(56) References Cited

U.S. PATENT DOCUMENTS 4,372,604 A * 2/1983 Raksanyi et al. ..... 297/162
5,567,011 A * 10/1996 Sessini ..... 297/284.7
6,322,483 B1 * 3/2000 Rottela ..... 482/129

* cited by examiner

*Primary Examiner*—Carl D. Friedman
*Assistant Examiner*—Nahid Amiri
(74) *Attorney, Agent, or Firm*—Flynn, Thiel, Boutell & Tanis, P.C.

(57) ABSTRACT

An upright space-dividing panel which mounts thereon a cushion usable as a back rest. The cushion is secured to the panel by at least one strap which is secured to the panel and overlies a side face thereof in a generally vertical orientation. The cushion includes a mounting arrangement on the rear side thereof which cooperatively engages with the strap to permit vertical sliding movement of the cushion relative to the panel so as to define a back rest which is usable in conjunction with a furniture component disposed adjacent the panel and defining a seating surface thereon.

11 Claims, 3 Drawing Sheets

UPRIGHT PANEL WITH HEIGHT ADJUSTABLE BACK CUSHION

FIELD OF THE INVENTION

This invention relates to an upright space-dividing panel such as used in offices and the like, and more particularly relates to a panel which adjustably mounts thereon a cushion usable as a back rest when used in conjunction with a furniture component defining a seating surface and disposed in adjacent relation with the panel.

BACKGROUND OF THE INVENTION

Upright space-dividing screen or panel arrangements for use in commercial and office environments are well known, and numerous variations of such arrangements have been developed. These panel arrangements typically employ upright space-dividing wall panels which serially connect together to subdivide the office area into a plurality of smaller workstations of desired size and configuration. Such panels cooperate with other furniture components to define an equipped workstation. These components may include worksurfaces, file cabinets, and shelf units which are mountable directly on and supportable by the panels, and also may include freestanding furniture components such as tables, chairs and file cabinets. Such a workstation or work area may be utilized by an individual as a personal work area, or may be utilized for other purposes such as a meeting area for project teams or groups.

The efficient use of available space is typically a concern when creating a work area, and conventional seating such as office chairs are often bulky and thus use up a great deal of space within a defined work area. Further, rearrangement of components within a work area is often desirable, particularly if the area is used for group meetings since various types of visual aids and other tools are used for presentation of information. It can therefore be necessary to arrange the work area to accommodate the particular tools being used, and to provide adequate seating for individuals.

The present invention was developed in an effort to provide greater flexibility in arranging a work space, and also to provide additional seating options within a work space. The invention includes an upright panel which mounts thereon a cushion or pad which defines a back rest when used in conjunction with a furniture component placed adjacent the panel. More specifically, the cushion is readily vertically adjustable along the panel so as to be usable with virtually any piece of office furniture capable of being used as a seating surface. The cushion mounts to the upright panel by at least one flexible strap which extends generally vertically along the panel and attaches to a rear side of the cushion. The cushion is vertically slidable relative to the strap so as to be usable with seating surfaces of various heights and to accommodate individuals of various sizes.

Other objects and purposes of the invention, and variations thereof, will be apparent upon reading the following specification and inspecting the accompanying drawings.

Figure 1:
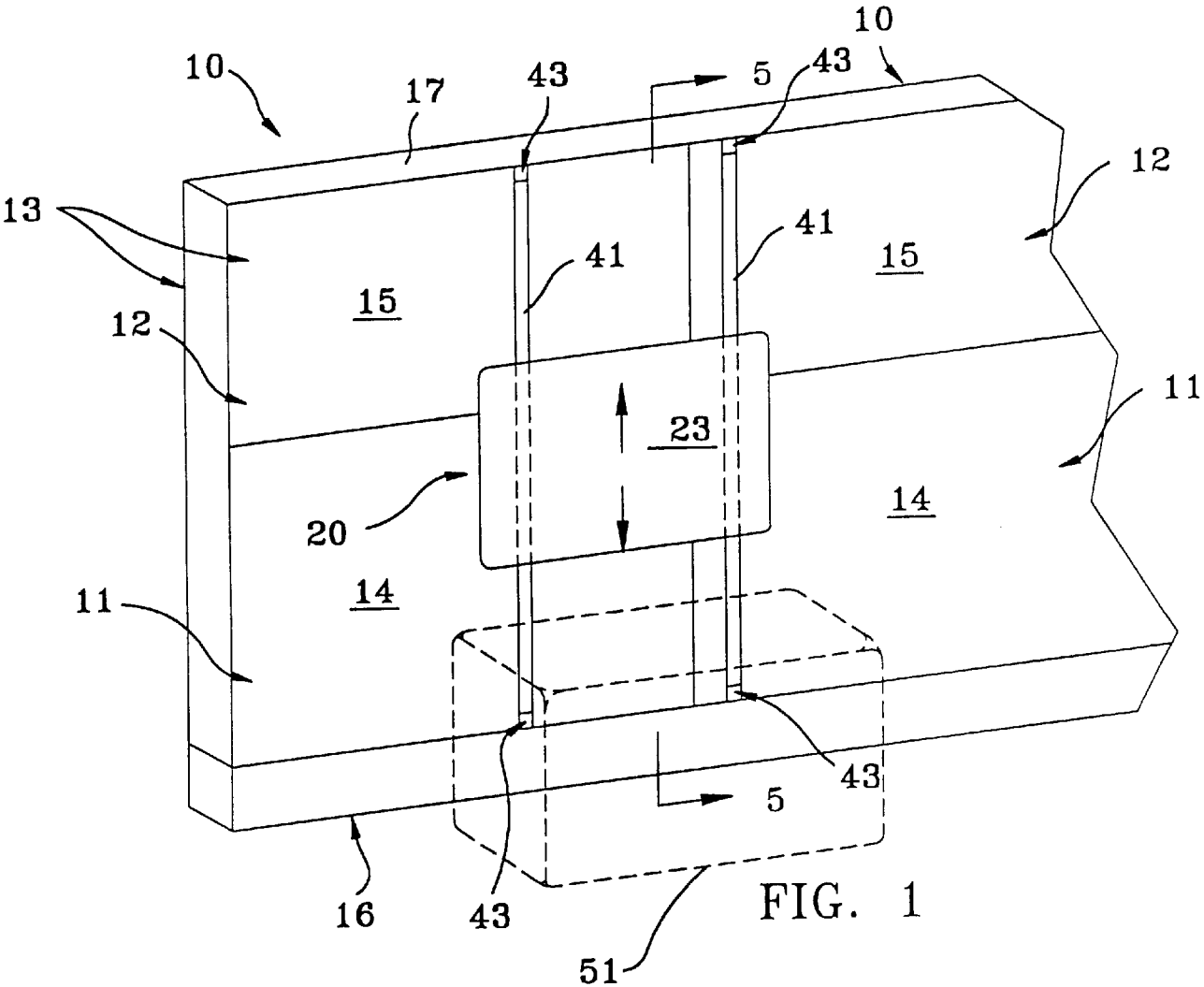
FIG. 1 is a fragmentary perspective view illustrating a wall panel arrangement including a panel assembly which mounts thereon a back cushion according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center and designated parts thereof. Said terminology will include the words specifically mentioned, derivatives thereof, and words of similar import.

DETAILED DESCRIPTION

FIG. 1 illustrates a portion of a space-dividing wall panel system including a plurality of upright wall panel assemblies 10 (only two of which are shown). The wall panel system includes a selected number of such wall panel assemblies 10 serially connected, for example, in two-panel straight (as shown) or angled, or three or four panel corner configurations so as to subdivide an office area into workstations or work areas. In the illustrated embodiment, the panel assembly 10 includes a base panel assembly 11 supported on a floor and typically includes one (as shown) or more modular extension panel assemblies 12 positioned vertically one above the other in a vertical plane. The wall height can be modularly adjusted by selective placement of one or more extension panel assemblies 12 vertically on each base panel assembly 11. The wall panel assembly 10 may support office components such as a shelf unit, a work surface, or other conventional furniture components while additional freestanding components such as chairs and filing cabinets can be positioned within the work area. Serially adjacent wall panel assemblies 10 are interconnected through a common vertical upright or post (not shown) disposed in load-bearing relation with a floor or other support surface.

The base panel assembly 11 includes a rectangular frame member (shown schematically only in dotted lines in FIG. 5) and a cover pad or panel 14 which overlies the frame member on each vertical side face thereof and defines an outer finished surface of the panel assembly 10. Similarly, each extension panel assembly 12 includes a frame arrangement (shown schematically in dotted lines in FIG. 5) defined by the panel-supporting posts and cross-members which extend transversely therebetween. The frame arrangement of extension panel assembly 12 mounts thereon a cover pad or panel 15 on opposite sides thereof.

The panel assembly 10 additionally includes a raceway arrangement 16 which is aligned with additional raceway arrangements of one or more adjacent panel assemblies so as to define a continuous horizontal raceway along the length of the wall panel system which is typically utilized for routing electrical arid/or communication cabling. A top cap or cover 17 is also provided which cooperates with the uppermost extension panel assembly 12 to provide a finished appearance.

The construction of the "stackable" type panel assembly discussed above is described in more detail in U.S. Pat. No. 5,806,258 and pending Application Serial No. 09/326,192, both of which are owned by the same assignee hereof and incorporated by reference herein. It will be appreciated that the above is an example of only one type of panel assembly which may be utilized in accordance with the invention. For example, the panel assembly may instead be of the type including a ring-like frame defined by parallel top and bottom frame rails rigidly joined together by a pair of parallel side frame rails. These rails surround and confine a core structure, with the frame and core structure being sandwiched between a pair of sheets which overlie the respective side faces of the panel member and are covered by an exterior covering such as a flexible fabric. The panel assembly may be interconnected to an adjacent panel assembly through a common upright or post, or alternatively may be disposed in direct load bearing relation with the floor.

Figure 2:
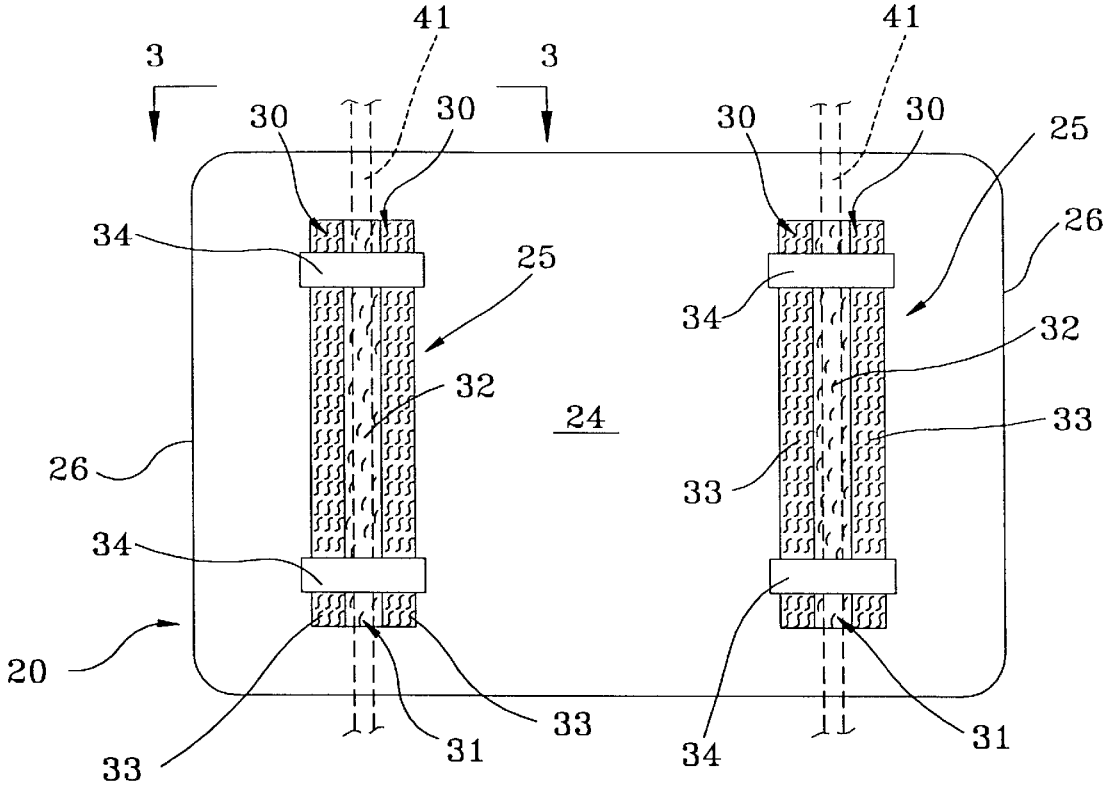
FIG. 2 is an enlarged view of the rear side of the cushion, with the panel mounting straps shown in broken lines.
Figure 3:
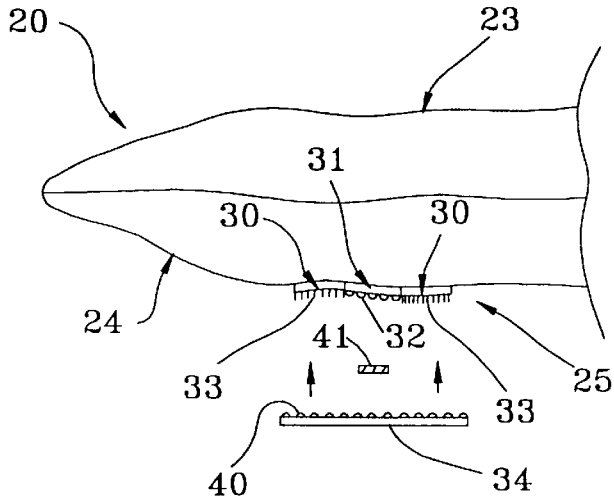
FIG. 3 is an enlarged, fragmentary and partially exploded overhead view of the cushion as seen generally along line 3—3 in FIG. 2.

Referring to FIGS. 1–3, a cushion or pad 20 which in the illustrated embodiment has a generally rectangular shape is mounted on the panel assembly 10 so that same is vertically adjustable therealong. The cushion 20 may include an outer cover, for example of fabric or other appropriate material. The cover may define an interior pocket in which a filler is provided, such as a foam insert or other suitable material. It will be appreciated that other cushion constructions would be within the scope of the invention, and the above is presented only as an example of one such construction.

The cushion 20 defines thereon a front side 23 for engagement with the back of the user, and a rear side 24 which faces the panel assembly 10. A pair of mounting elements 25 are attached to the rear side 24 of the cushion 20 in generally parallel relation with respective upright side edges 26 thereof such that the mounting elements 25 are generally vertically oriented and horizontally spaced from one another on rear side 24 of the cushion 20. The mounting elements 25 are identical to one another, and only one of which will therefore be described in detail herein.

Mounting element 25 includes three elongate tape-like strips, and specifically two outer strips 30 and one inner strip 31 situated therebetween which form part of a hook-and-loop type fastening arrangement, such as that commonly sold under the trademark VELCRO®. The inner strip 31 can be attached on opposite longitudinal edges thereof to inner longitudinal edges of the respective adjacent outer strips 30, for example by stitching so as to form a continuous elongate strip. The inner and outer strips 31 and 30 have similar lengths and widths and when attached to one another provide the respective mounting element 25 with a generally rectangular shape as shown in FIG. 2. The inner and outer strips 31 and 30 are embodied by pieces of flexible woven material or fabric such as nylon, for example, and define respective fastening areas 32 and 33 thereon. The fastening areas 33 of outer strips 30 each include a plurality of hooks along the length thereof, and the fastening area 32 of the inner strip 31 includes a plurality of loops along the length thereof.

The respective strips 30, 31 of mounting element 25 may be secured directly to the rear side 24 of cushion 20, for example by stitching or adhesive, or alternatively may be fastened to a backing strip which is in turn fastened to rear side 24. As a further alternative, it may not be necessary to secure the respective strips 30, 31 to one another, and instead the strips may be fastened to rear side 24 either directly or via a backing strip in side-by-side relation with one another.

With continued reference to FIGS. 2 and 3, a pair of securing strips or patches 34 cooperate with each mounting element 25. The securing strips 34 are identical to one another, and only one of which will be described in detail. Securing strip 34 in the illustrated embodiment is generally rectangular in shape, and has a width which is similar to the width of the respective mounting elements 25 and a length which is a small fraction of the length thereof. The securing strip 34, in accordance with one embodiment, is a piece of flexible woven material defining a fastening area 40 thereon including a plurality of loops disposed across the entire width thereof which engage with the fastening areas 33 of the outer strips 30 as discussed below.

Figure 4:
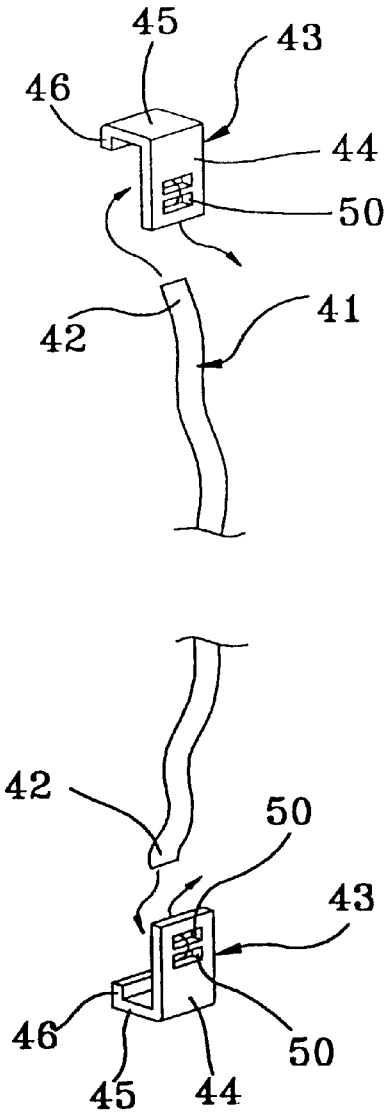
FIG. 4 is an enlarged, fragmentary, exploded view of one of the panel mounting straps and the associated mounting clips.

At least one, and in the illustrated embodiment two, elongate and identical panel mounting straps 41 are provided to attach the cushion 20 on the panel assembly 10. The straps 41 are constructed of a thin flexible material, such as fabric, and may be constructed of nylon and polyester, for example. As shown in FIG. 4, each fastening strap 41 has a pair of free ends 42 which cooperate with respective mounting clips or buckles 43. The clips 43 are identical to one another and only one is described herein. The clip 43 includes an upright wall 44 which at one edge thereof is joined to a generally horizontal base wall 45. The rearmost edge of base wall 45 is in turn joined to a flange 46 which is cantilevered from base wall 45 in generally parallel relation with wall 44, such that the clip 43 is generally J-shaped when viewed from the side and defines either an upwardly or downwardly opening channel depending upon the orientation of the clip 43. Wall 44 defines therein a pair of elongate and generally horizontal slots 50 which are parallel to, and vertically spaced from one another. In the illustrated embodiment, the clips 43 are constructed of metal, and are relatively thin to permit limited flexibility thereof.

The cushion 20 is mounted to the panel assembly 10 as follows. A pair of clips 43 are fastened to the panel assembly 10 along the upper and lower regions thereof. More specifically, with reference to FIG. 5, the base wall 45 and the associated flange 46 of one clip 43 are inserted between the lower edge of the cover pad 14 and the upper edge of the raceway arrangement 16 so that the lower edge of the cover pad 14 engages within the upwardly-opening channel of the clip 43 and so that upright wall 44, base wall 45 and flange 46 thereof respectively overlie the front, lower and inwardly facing sides of the cover pad 14. Another clip 43 is then mounted to the upper cover pad 15 in vertical alignment with the lower clip 43. The upper clip 43 is inverted relative to the lower clip 43 so that the channel thereof opens downwardly, and the base wall 45 and flange 46 are inserted between the upper edge of cover pad 15 and the lower edge of the top cap 17 so that the upper edge of pad 15 engages within the downwardly-opening clip channel and the upright wall 44, base wall 45 and flange 46 respectively overlie the front, upper and inwardly facing sides of the cover pad 15.

Figure 5:
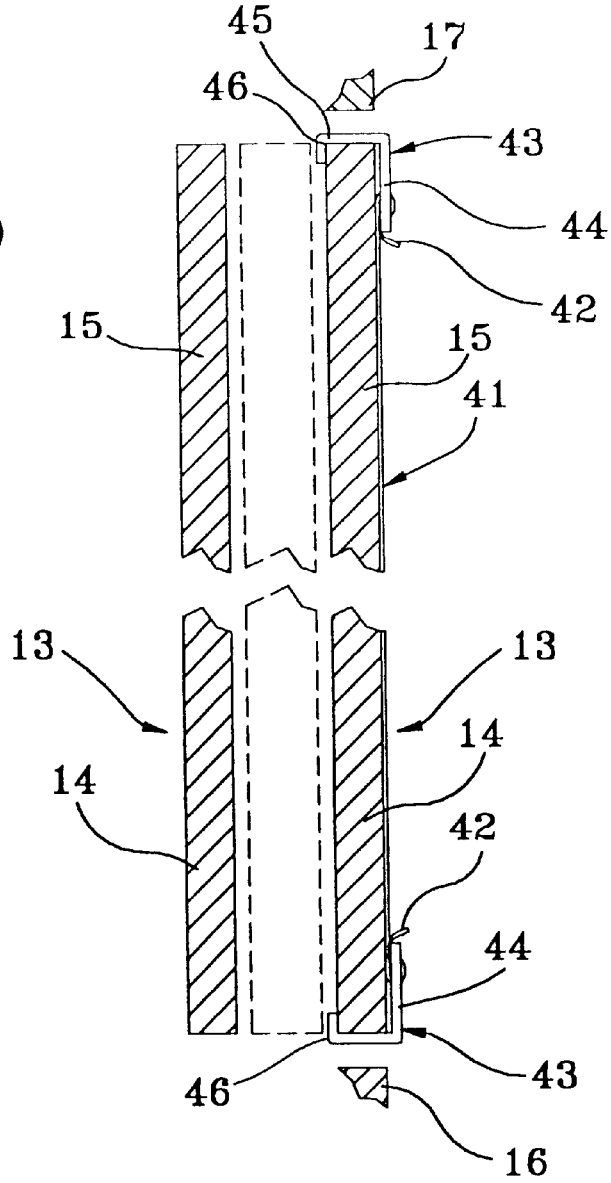
FIG. 5 is an enlarged, fragmentary cross-sectional view taken generally along line 5—5 in FIG. 1.

An additional pair of clips 43 are then mounted on the upper and lower edges of the panel assembly 10 in a similar manner so as to be horizontally spaced from the first set of clips. This distance between the adjacent pairs of upper and lower clips 43 should be substantially equal to the horizontal distance between the respective inner strips 31 of cushion 20. The fastening straps 41 are then assembled to the respective pairs of upper and lower clips 43. More specifically, a free end 42 of one strap 41 is inserted behind upright wall 44 of lower clip 43 (i.e. between the front surface of cover pad 14 and wall 44) and threaded into and outwardly through the lowermost slot 50. The free end 42, now on the frontmost side of wall 44, is then threaded rearwardly into and through the uppermost slot 50 and pulled upwardly so that the free end 42 projects between the upper edge of wall 44 and the front face of the cover pad 14 as shown in FIG. 5.

The opposite free end 42 of fastening strap 41 is then inserted between wall 44 of the upper clip 43 and the front face of cover pad 15 and threaded into the uppermost slot 50 of wall 44, downwardly into the lowermost slot 50 of upper clip 43 so as to extend rearwardly between the wall 44 and the front face of cover pad 15, and is then pulled downwardly so that the free end 42 projects between the lower edge of wall 44 of lower clip 43 and the face of cover pad 15. The tension of the strap 41 is adjusted by pulling on either of the exposed free ends 42 of the strap so as to provide a snug engagement of the strap 41 on panel assembly 10. The other fastening strap 41 is then attached to remaining pair of upper and lower clips 43 in a similar fashion, so that once the straps 41 are assembled onto the panel assembly 10, the straps 41 extend vertically along the panel and are generally parallel to one another as shown in FIG. 1.

Two securing strips 34 are then partially fastened to each mounting element 25 in vertically spaced relation with one another. In this regard, the strips 34 are positioned so that the fastening areas 40 thereof face the fastening areas 32 and 33 of the respective mounting element 25, and one of the vertical side edges of the strip 34 can be pressed against the corresponding outer strip 30 of mounting element 25 to engage the opposed fastening areas 33 and 40 so as to hold the strip 34 in place on element 25 during assembly of the cushion 20 to the panel assembly 10. Alternatively, the strips 34 can be sewn along one of the vertical side edges thereof to a vertical outer side edge of the corresponding outer strip 30 so as to permanently fasten strips 34 to element 35. The strips 34 as partially fastened to the mounting element 25 respectively define flaps. With the fastener strips 34 secured to the respective mounting elements 25, the free ends of the upper and lower strips 34 of one mounting element 25 are then inserted between the strap 41 and the front face of the panel assembly 10 so that the strap 41 overlies the inner strip 31 of the respective mounting element 25, and the free ends of the respective upper and lower strips 34 are then pressed against the corresponding outer strip 30 to engage the opposed fastening areas 33 and 40. The mounting element 25 and the respective strips 34 thus form a pair of closed loops which completely surround and confine the strap 41. The other fastener strips 34 are then assembled to the opposite mounting element 25 and strap 41 in a similar manner.

The cushion 20 is now mounted on the panel assembly 10 and the vertical height thereof can be adjusted by manually sliding the cushion 20 to the desired height. The arrangement of the fastening areas on the mounting elements 25 and the respective strips 34 allow an opening or non-engaged area to remain therebetween in which the respective straps 41 are disposed which allows sliding of the cushion 20 relative to the straps 41. These open areas are defined between the non-engaged loops on inner strip 31 and the non-engaged loops disposed in the central region of the respective strips 34. The strap 41 is sandwiched between these opposed non-engaging loop areas and the loop areas frictionally engage the opposite sides of the strap 41 and may even cause some deformation of the strap 41. The frictional engagement between these opposed loop areas and the strap 41 maintains the cushion 20 in the selected vertical position relative to the panel assembly 10, until a sufficient upward or downward force is applied to the cushion 20 to adjust the position of same.

The cushion 20 can be mounted on a panel assembly which defines an office area in any convenient location, and various types of office furniture usable as a seating surface can then be placed adjacent the panel below the cushion 20 to create a seat within the work area. For example, an office furniture component 51 (shown in dotted lines in FIG. 1) can be positioned against the panel assembly beneath the cushion 20 and serve as seating surface. The component 51 may be a storage unit such as a file cabinet, book case or shelf unit. Further, stools or other portable types of seating components can also be used in conjunction with the cushion 20. Thus, the use of conventional bulky seating such as office chairs can be minimized, and additional seating areas can be created using existing office furniture components.

It will be appreciated that the pairs of vertically-spaced securing strips 34 may instead be embodied by single elongate strips which overlie a substantial portion of the respective mounting elements 25. Further, only one of the clips 43 which mount each of the straps 41 to the panel assembly 10 may be configured with slots 50 so as to allow tensioning of the respective strap 41. Still further, only one mounting element 25 may be provided centrally on the rear side 24 of cushion 20 for cooperation with a single strap 41 mounted on panel assembly 10.

It will also be appreciated that while the clips 43 are mounted to a panel assembly 10 in which spaces are defined between upper and lower edges of the pads 14 and 15 or panel members and the adjacent raceway arrangement 16 and top cap 17, respectively, the cushion 20 can also be mounted on other types of panel assemblies which may not define such spaces. For example, many conventional panel assemblies include raceway arrangements which include openable side covers which allow access to the lower edge of the panel member, as well as removable top caps which provide access to the upper edge of the panel member.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A workstation comprising:

an upright space-dividing wall panel including a pair of spaced-apart upright ends and generally horizontally oriented upper and lower edge portions extending laterally between said ends, and a pair of oppositely facing and generally vertically oriented side surfaces;

a cushion mounted on said wall panel so as to overlie one of said side surfaces;

a mounting arrangement for vertically adjustably attaching said cushion to said wall panel, said mounting arrangement including an elongate strap attached to said wall panel and extending generally Vertically along said one side surface, a first mounting strip fixed to a rear surface of said cushion, and a second mounting strip superimposed on said first mounting strip, said first and second mounting strips defining opposed pressure sensitive fastening areas and said strap being sandwiched between said opposed fastening areas such that said cushion is vertically slidable relative thereto; and a furniture component defining a seating surface thereon, said furniture component being disposed in adjacent relation with said one side surface of said wall panel generally below said cushion such that said cushion and said seating surface of said furniture component together define a seating area with said cushion being disposed at a height which renders same usable as a backrest.

2. The workstation of claim 1 wherein said strap is removably attached to said wall panel adjacent said upper and lower edge portions thereof, and said first and second mounting strips define a closed loop around said strap to permit sliding movement of said cushion relative to said scrap and allow vertical adjustment of said cushion relative to said wall panel.

3. The workstation of claim 1 wherein said first and second mounting strips are fastened to one another along respective outer edge portions thereof such that an opening is defined centrally therebetween through which said strap extends to allow vertical movement of said cushion relative thereto.

4. A wall, panel assembly comprising:

an upright space-dividing panel member defining upper and lower generally horizontal edge portions which extend between a pair of horizontally spaced and generally vertically oriented end portions, and a pair of upright and generally planar side surfaces which define respective outer faces of said panel member;

a vertically elongate strap defining a pair of free ends removably attached to said panel member adjacent said upper and lower edge portions thereof such that said strap extends vertically along a substantial portion of one of said side surfaces of said panel member; and a pad removably attached to said strap to mount said pad to said panel member, said pad being disposed in superimposed relation with said one side surface so as to define a back rest when used in conjunction with a furniture component defining a seating surface thereon.

5. The wall panel assembly of claim 4 wherein said pad mounts thereon a vertically elongate mounting element on a rear side thereof which faces said one side surface, said mounting element removably engaging said strap and being configured to permit relative movement between said strap and said pad to allow vertical adjustment of said pad relative to said panel member so as to be usable in conjunction with furniture components of various sizes.

6. The wall panel assembly of claim 4 wherein a mounting arrangement is attached to a rear side of said pad for cooperation with said strap, said mounting arrangement including a pair of opposed elements which define respective opposed pressure sensitive fastening areas thereon, said strap being sandwiched between the opposed elements.

7. The wall panel assembly of claim 4 wherein a pair of mounting clips are respectively attached to free ends of said strap, one of said mounting clips being removably attached to said upper edge portion of said panel member and the other said mounting clip being removably attached to said lower edge portion of said panel member.

8. An upright wall panel system comprising:

a plurality of upright wall panel assemblies which are serially connected to one another to define a work area, each said panel assembly including an upright panel member defining upper and lower edge portions and a vertically oriented side surface; and a back rest arrangement mounted to one of said panel members and including a pair of vertically elongate and flexible straps, each of said straps having a pair of free ends which are respectively mounted to said upper and lower edge portions of said one panel member such that said straps extend vertically along said one panel member and are laterally spaced from one another therealong, and a cushion defining a rear side which faces said one panel member and a front side which faces outwardly and away from said one panel member, said rear side mounting thereon a pair of laterally spaced mounting elements which cooperatively engage the respective said straps to attach said cushion to said straps and permit vertical sliding movement of said cushion relative to said one panel member such that said front side of said cushion defines a back rest and is usable in conjunction with any furniture component disposed adjacent said one panel member and defining a seating area thereon.

9. The wall panel system of claim 8 wherein said mounting elements each include a pair of opposed mounting strips which define thereon opposed pressure sensitive fastening areas which releasably engage one another, the respective said strap being sandwiched between said fastening areas of said mounting strips and being movable relative thereto to permit adjustment of the vertical position of said cushion relative to said one panel member.

10. The wall panel system of claim 9 wherein first ones of said mounting strips are secured to said rear side of said cushion such that said fastening areas thereof face away from said rear side, and said fastening areas of second ones of said mounting strips face towards said rear side, said fastening area of each said first mounting strip including a pair of outer areas having a plurality of hooks thereon and a central area disposed between said outer areas and having a plurality of loops thereon, and said fastening area of each said second mounting strip including a plurality of loops thereon such that when said fastening areas of said second mounting strips are engaged with the respective fastening areas of said first mounting strips, a non-engaged open area is defined therebetween in which the respective said strap is disposed.

11. The wall panel system of claim 10 wherein each said non-engaged open area defined between the opposed first and second mounting strips is defined by opposed loop portions thereof, said opposed loop portions frictionally engaging said strap to retain said cushion at the desired vertical height relative to said one panel member until a sufficient manual force is applied to said cushion to move same relative to said straps.

* * * * *

UNITED STATES PATENT AND TRADEMARK OFFICE

CERTIFICATE OF CORRECTION

PATENT NO. : 6,557,307 B2
DATED : May 6, 2003
INVENTOR(S) : Ralph E. Reddig

It is certified that error appears in the above-identified patent and that said Letters Patent is hereby corrected as shown below:

Column 6,
Line 47, change “Vertically” to -- vertically --.

Column 7,
Line 2, change “scrap” to -- strap --.
Line 10, after “wall” delete -- , --.

Signed and Sealed this

Twenty-second Day of July, 2003

JAMES E. ROGAN
*Director of the United States Patent and Trademark Office*